US008764916B2

(12) United States Patent
Donsbach et al.

(10) Patent No.: US 8,764,916 B2
(45) Date of Patent: Jul. 1, 2014

(54) AGENT FOR THE PRODUCTION OF ANTI-CORROSION LAYERS ON METAL SURFACES

(75) Inventors: Hermann Donsbach, Trebur (DE); Udo Hofmann, Pfungstadt (DE); Joerg Unger, Trebur (DE)

(73) Assignee: Atotech Deutschland GmbH, Berlin (DE)

( * ) Notice: Subject to any disclaimer, the term of this patent is extended or adjusted under 35 U.S.C. 154(b) by 759 days.

(21) Appl. No.: 12/593,632

(22) PCT Filed: Mar. 20, 2008

(86) PCT No.: PCT/EP2008/053346

§ 371 (c)(1),
(2), (4) Date: Nov. 3, 2009

(87) PCT Pub. No.: WO2008/119675

PCT Pub. Date: Oct. 9, 2008

(65) Prior Publication Data

US 2010/0126633 A1 May 27, 2010

(30) Foreign Application Priority Data

Mar. 29, 2007 (EP) ..... 07105237

(51) Int. Cl.
*C23C 22/44* (2006.01)
*C23C 22/00* (2006.01)

(52) U.S. Cl.
USPC ..... 148/247; 106/14.05; 106/14.11; 148/243

(58) Field of Classification Search
CPC ..... C23C 22/34; C23C 22/364; C23C 22/40; C23C 22/44
USPC ..... 148/247
See application file for complete search history.

(56) References Cited

U.S. PATENT DOCUMENTS

| | | | | |
|---|---|---|---|---|
| 5,743,971 | A * | 4/1998 | Inoue et al. | 148/247 |
| 6,193,815 | B1 * | 2/2001 | Wada et al. | 148/247 |
| 6,524,403 | B1 | 2/2003 | Bartlett et al. | |
| 6,749,694 | B2 * | 6/2004 | Greene et al. | 148/243 |

FOREIGN PATENT DOCUMENTS

| | | | |
|---|---|---|---|
| EP | 0358338 | A2 | 8/1989 |
| EP | 0760401 | A1 | 3/1997 |
| JP | 04 132 636 | A | 5/1992 |
| WO | W00186016 | A2 | 11/2001 |

* cited by examiner

*Primary Examiner* — Lois Zheng
(74) *Attorney, Agent, or Firm* — Paul & Paul

(57) ABSTRACT

An agent for the production of anti-corrosion layers on metal surfaces is produced by producing an aqueous solution, which contains at least oxo-cations and halogen complex anions, and forming nanoparticles in the solution in situ by physical and/or chemical treatment of the solution. The oxo-cations are selected from $MnO_3^+$, $VO^{3+}$, $VO^{2+}$, $WO_2^{2+}$, $MoO_2^{2+}$, $TiO^{2+}$, $ZrO^{2+}$ and mixtures thereof, and the halogen complex anions have the structure $MX_a^{b-}$, wherein M is selected from B, Ti, Zr, Si, Al, X is selected from F, Cl, Br, I, a is an integer of between 3 and 6 and b is an integer of between 1 and 4. The nanoparticles have a mean particle diameter of <500 nm.

21 Claims, No Drawings

AGENT FOR THE PRODUCTION OF ANTI-CORROSION LAYERS ON METAL SURFACES

The present invention concerns agents for the production of anti-corrosion layers on metal surfaces, processes for the production of such agents and use thereof.

The agents according to the invention serve in particular for the production of corrosion-resistant conversion layers or passivation layers on metal surfaces such as the surfaces of pure metal substrates such as zinc, aluminum, magnesium or alloys thereof and galvanically produced surfaces of zinc or alloys thereof.

BACKGROUND OF THE INVENTION

To provide protection from corrosion metal parts are for example galvanically coated with base metals such as for example zinc, nickel, chromium, aluminum, magnesium and alloys of the aforementioned, and the resistance to corrosion of the metal coating is further improved by production of a conversion layer, frequently a passivation layer. To produce a passivation layer the metal surfaces are in many cases treated with chromium (VI)-bearing solutions. However, because of the high toxicity and cancerogenity of chromium (VI)-compounds in recent times manufacturers have changed over to producing such conversion layers with chromium (III)-bearing solutions. In many cases large amounts of cobalt (II)-compounds are added to those chromium (III)-bearing treatment liquids, to increase the anti-corrosion action of the conversion layers produced. It will be noted however that those treatment solutions also represent a problem as both chromium (III) and also cobalt (II) are not completely safe in view of their toxicity and it is not possible to ensure on the basis of analytical problems that the conversion layers are free of chromium (VI). There is therefore an urgent need to produce completely chromium- and cobalt-free anti-corrosion layers.

Recent processes produce protective layers having a binder system on an organic or silicon-organic base, to which corrosion-inhibiting or layer-reinforcing additives based on molybdenum, tungsten, titanium, zirconium, vanadium and other metals are added.

U.S. Pat. No. 6,524,403 describes a chromium-free composition for improving the resistance to corrosion of zinc or zinc alloy surfaces, wherein the composition contains a source for titanium ions or titanates, an oxidising agent and fluorides as well as compounds of metals of group II and the composition is substantially free of silicates and silicon dioxide. In particular strontium is used as the metal of group II.

EP 0 760 401 discloses an anti-corrosion composition which contains an oxidising agent, a silicate and/or silicon dioxide and metal cations, selected from Ti, Zr, Ce, Sr, V, W and Mo, oxymetal anions thereof and/or fluorometal anions thereof.

The chromium-free anti-corrosion agents known hitherto suffer from the disadvantage that either they do not provide adequate anti-corrosion properties in respect of the corrosion layers or they are not sufficiently stable to be used in a continuous process, or both.

OBJECT OF THE INVENTION

The object of the invention was to overcome the disadvantages of the agents known in the state of the art for the production of anti-corrosion layers or conversion layers on metal surfaces, in particular surfaces of zinc, aluminum, magnesium or alloys thereof, wherein the agents are to be free of chromium and cobalt.

DESCRIPTION OF THE INVENTION

That object is attained by an agent for the production of anti-corrosion layers on metal surfaces, produced by the following steps:

A) producing an aqueous solution which contains at least the following:

a) oxo-cations selected from $MnO_3^{+}$, $VO^{3+}$, $VO^{2+}$, $WO_2^{2+}$, $MoO_2^{2+}$, $TiO^{2+}$, $ZrO^{2+}$ and mixtures thereof, and b) halogen complex anions of the structure $MX_a^{b-}$, wherein M is selected from B, Ti, Zr, Si, Al, X is selected from F, Cl, Br, I, a is an integer of between 3 and 6 and b is an integer of between 1 and 4, and B) forming nanoparticles having a mean particle diameter of <500 nm in the solution in situ by physical and/or chemical treatment of the solution, wherein the physical and/or chemical treatment is selected among a change in temperature, a change in the ion concentration, a change in the pH-value, a change in the pressure, supersaturation of the solution, agitation of the solution, adding an oxidising agent and/or adding a reducing agent.

The agent according to the invention is distinguished inter alia in that it contains nanoparticles which were produced in situ and which are stable or at least metastable. In the treatment of metal surfaces with the agent according to the invention a conversion layer or passivation layer is formed. The nanoparticles produced in situ in the treatment solution are incorporated into the conversion layer in the formation thereof and thereby provide a particularly high level of anti-corrosion action for the treated metal surfaces. In the agent according to the invention those nanoparticles are produced in situ by hydrolysis or oxidation of the substances contained in the starting solution. The nanoparticles are not added to the solution from the exterior, in the form of nanoparticulate particles which are already present. It has surprisingly been found that the nanoparticles produced in situ in accordance with the invention are better incorporated into the conversion layers and thereby those layers become denser and thus more corrosion-resistant than those which can be produced by application of an anti-corrosion solution to which nanoparticles were added from the exterior, for example in the form of a silica or silicate solution.

The nanoparticles in the agent according to the invention are produced in situ by physical and/or chemical treatment of the starting solution, thereby producing a colloidal solution. Formation of the nanoparticles can be easily detected by means of a Tyndall lamp. The nanoparticles are of a mean particle diameter of <500 nm. In a preferred embodiment of the invention the nanoparticles formed in step B) are of a mean particle diameter of <250 nm, preferably <200 nm, particularly preferably <150 nm.

The nanoparticles are produced from the halogen complex anions and/or oxo-cations by hydrolysis or oxidation. The nanoparticles thus substantially comprise the oxides of the metals or metalloids.

Without the applicants hereby being bound down to a theory it is assumed that the formation of nanoparticles in situ by the physical and/or chemical treatment is effected by a procedure whereby the initially present equilibrium state of the starting solution is converted into a disequilibrium state and the system is stabilised in a metastable state. Conversion from the equilibrium state into a disequilibrium state can be effected by a change in temperature, a change in ion concentration, a change in the pH-value, a change in pressure, supersaturation of the solution, agitation of the solution, addition of an oxidising agent and/or addition of a reducing agent. In a preferred embodiment of the invention formation of the nanoparticles in situ is effected by supersaturation of the solution and/or agitation of the solution.

The agent according to the invention can be prepared in various forms and production stages prior to the treatment of metal surfaces, as commercial products. Preferably the agent according to the invention is provided in the form of a concentrate which is still to be diluted prior to use. The agent according to the invention is suitable as a commercial product as soon as the aqueous solution containing oxo-cations and halogen complex anions is produced in accordance with step A) and the nanoparticles are formed in accordance with step B) in situ.

In a preferred embodiment of the invention in a further step C) there is added to the solution produced in accordance with step B) an oxidative substance selected from hydrogen peroxide, organic peroxides, alkali metal peroxides, persulfates, perborates, nitrates and mixtures thereof, wherein the addition of hydrogen peroxide as the oxidative substances is particularly preferred. The addition of the oxidative substance is desirably effected prior to use of the agent according to the invention for the production of anti-corrosion layers, wherein the agent according to the invention can already be provided with the oxidative substance contained therein or the oxidative substance is added only just prior to use of the agent according to the invention at the manufacturer of the anti-corrosion layers.

The addition of the oxidative substance prior to use of the agent according to the invention for the production of anti-corrosion layers causes inter alia pre-passivation of the metallic surface, in particular a zinc or zinc alloy surface, which is advantageous as the treatment solution can be extremely aggressive to the metallic surface and could at least partially dissolve it.

In a further preferred embodiment of the agent according to the invention in a further step D) the pH-value is adjusted by means of an acid or base to a value in the range of between 0.5 and 5.0, preferably in the range of between 1.0 to 3.0, particularly preferably in the range of between 1.3 and 2.0. That is particularly advantageous if the agent according to the invention is used for the production of anti-corrosion layers on zinc or zinc alloy surfaces. Adjustment of the acid pH-value which is preferred according to the invention ensures adequate removal of the metallic substrate so that the metal surface is substantially completely freed of impurities adhering thereto and the anti-corrosion layer can then be formed completely and without any gap over the entire surface.

In a further preferred embodiment of the invention the agent according to the invention is produced by a procedure whereby the formation of nanoparticles in accordance with step B) is effected at a temperature in the range of between ambient temperature and 100° C., preferably in the range of between 30° C. and 80° C., particularly preferably in the range of between 35° C. and 50° C. With an excessively low temperature, the formation of nanoparticles occurs at an uneconomically slow speed. In addition there is the danger that the particles combine together and the nanoparticulate character is lost. An excessively high temperature has the disadvantage that the metastable state is not reached and no nanoparticles are formed.

In a further preferred embodiment of the invention the agent is produced by a procedure whereby the halogen complex anions b) of the aqueous solution in step A are added in the form of their metal salts, preferably their alkali metal salts, particularly preferably their sodium and potassium salts. The addition of the solids is quite particularly preferred, using a procedure whereby firstly an aqueous solution of the oxo-cations a) is provided and the solid containing the halogen complex anions is added and dissolved.

In a quite particularly preferred feature according to the invention the halogen complex anions b) are fluoroanions selected from $BF_4^{1-}$, $TiF_6^{2-}$, $ZrF_6^{2-}$, $SiF_6^{2-}$, $AlF_6^{3-}$ and mixtures thereof.

In a further preferred embodiment according to the invention there are added to the aqueous solution in step A) further metal salts, preferably salts of the metals B, Ti, Zr, Si and/or Al. Preferably the metals are added in the form of the metal halides, metal nitrates and/or metal sulfates. That provides that the color configuration of the protective layer can be modified and/or corrosion protection increased.

In a further preferred embodiment of the invention the aqueous solution produced in step A) contains the oxo-cations in a concentration of between 0.1 and 0.5% by weight, preferably in a concentration of between 0.1 and 0.3% by weight.

In a further preferred embodiment of the invention the aqueous solution produced in step A) contains the halogen complex anions in a concentration of between 0.1 and 3.0% by weight, preferably in a concentration of between 0.5 and 2.0% by weight.

As was already stated hereinbefore the agent according to the invention can be provided in the form of a concentrate which is to be diluted prior to use. Alternatively the agent according to the invention can already be provided in the dilution or concentration suitable for use. In that case desirably the solution obtained in step B) is diluted with water in a ratio of between 1:3 and 1:5 prior to or after the addition of an oxidative substance in step C).

Use of the agent according to the invention for the production of anti-corrosion layers is effected by direct treatment of the metal surfaces with the agent, preferably by dipping the articles with metal surfaces into the agent or swinging such articles into the agent. Use by dipping or swinging is preferably effected at a temperature of the treatment bath in the range of between 20 and 100° C., preferably between 30 and 70° C., more preferably between 40 and 60° C. and particularly preferably at about 50° C.

The most suitable treatment duration for production of anti-corrosion layers by dipping or swinging the articles with metal surfaces into or in the treatment bath varies in dependence on various parameters such as for example the composition of the treatment solution, the treatment temperature, the nature of the metal surface and the degree of the desired resistance to corrosion. In the case of metal surfaces of zinc or zinc alloy a suitable treatment time is in the range of between 10 and 120 seconds, preferably in the range of 20 to 60 seconds.

Further advantages, features and embodiments of the present invention will be apparent by reference to the Examples hereinafter.

EXAMPLES AND COMPARATIVE EXAMPLES

An aqueous solution of oxo-anions a) is produced for the production of agents according to the invention and comparative compositions. Then with slight agitation the halogen complex anions component b), in this example a fluoroanions component, is dissolved as a solid in 800 ml of the previously produced solution. That solution is then subjected to a physical and/or chemical treatment by vigorous agitation (propeller agitator, between 700 and 1000 rpm). The formation of nanoparticles is checked by means of a Tyndall lamp. The solution obtained is then made up with water to 1 l.

Prior to use for the production of anti-corrosion layers the previously produced solution is diluted in a ratio of 1:4 with water (1 l solution plus 3 l water). Then 1 liter of 10% $H_2O_2$ solution is added and the pH-value is adjusted with NaOH or $HNO_3$ to a value of between 1.5 and 1.8. The individual components of the solutions produced (5 liters of solution per batch) and the physical and/or chemical treatments are reproduced in Table 1 hereinafter.

TABLE 1

| Treatment solution No | Oxo-anions a) (% by wt) | Fluoroanions component b) | Physical and/or chemical treatment | Tyndall effect |
|---|---|---|---|---|
| 1a (invention) | $VOSO_4$ 0.25% by wt | $K_2TiF_6$ 13.6 g | Agitation 40° C. 30 min | positive |
| 1b (Comp. Ex) | $VOSO_4$ 0.25% by wt | $K_2TiF_6$ 13.6 g | Standing 40° C. 30 min | negative |
| 2a (Comp. Ex) | $VOSO_4$ 0.25% by wt | $H_2TiF_6$ 9.1 g | Agitation 40° C. 30 min | negative |
| 2b (Comp. Ex) | $VOSO_4$ 0.25% by wt | $H_2TiF_6$ 9.1 g | Standing 40° C. 30 min | negative |
| 3a (invention) | $TiOSO_4$ 0.25% by wt | $K_2TiF_6$ 13.6 g | Agitation 40° C. 30 min | positive |
| 3b (Comp. Ex) | $TiOSO_4$ 0.25% by wt | $K_2TiF_6$ 13.6 g | Standing 40° C. 30 min | negative |
| 4a (Comp. Ex) | $TiOSO_4$ 0.25% by wt | $H_2TiF_6$ 9.1 g | Agitation 40° C. 30 min | negative |
| 4b (Comp. Ex) | $TiOSO_4$ 0.25% by wt | $H_2TiF_6$ 9.1 g | Standing 40° C. 30 min | negative |
| 5a (invention) | $TiOSO_4$ 0.25% by wt | $K_2AlF_6$ 14.2 g | Agitation 40° C. 30 min | positive |
| 5b (Comp. Ex) | $TiOSO_4$ 0.25% by wt | $K_2AlF_6$ 14.2 g | Standing 40° C. 30 min | negative |
| 6a (invention) | $TiOSO_4$ 0.25% by wt | $K_2SiF_6$ 12.5 g | Agitation 40° C. 30 min | positive |
| 6b (Comp. Ex) | $TiOSO_4$ 0.25% by wt | $K_2SiF_6$ 12.5 g | Standing 40° C. 30 min | negative |
| 7a (Comp. Ex) | $TiOSO_4$ 0.25% by wt | $H_2SiF_6$ 7.9 g | Agitation 40° C. 30 min | negative |
| 7b (Comp. Ex) | $TiOSO_4$ 0.25% by wt | $H_2SiF_6$ 7.9 g | Standing 40° C. 30 min | negative |
| 8a (invention) | $TiOSO_4$ 0.25% by wt | $K_2ZrF_6$ 16.0 g | Agitation 40° C. 30 min | positive |
| 8b (Comp. Ex) | $TiOSO_4$ 0.25% by wt | $K_2ZrF_6$ 16.0 g | Standing 40° C. 30 min | negative |
| 9a (Comp. Ex) | $TiOSO_4$ 0.25% by wt | $H_2ZrF_6$ 9.7 g | Agitation 40° C. 30 min | negative |
| 9b (Comp. Ex) | $TiOSO_4$ 0.25% by wt | $H_2ZrF_6$ 9.7 g | Standing 40° C. 30 min | negative |
| 10a (invention) | $ZrOSO_4$ 0.25% by wt | $K_2TiF_6$ 13.6 g | Agitation 40° C. 30 min | positive |
| 10b (Comp. Ex) | $ZrOSO_4$ 0.25% by wt | $K_2TiF_6$ 13.6 g | Standing 40° C. 30 min | negative |
| 11a (Comp. Ex) | $ZrOSO_4$ 0.25% by wt | $H_2TiF_6$ 9.1 g | Agitation 40° C. 30 min | negative |
| 11b (Comp. Ex) | $ZrOSO_4$ 0.25% by wt | $H_2TiF_6$ 9.1 g | Standing 40° C. 30 min | negative |

Table 1 shows that, without treatment for the solutions by agitation (solutions 1b through 11b), no Tyndall effect was observed and thus no formation of nanoparticles was achieved. The same was observed if the fluoroanions component was used in the form of its free acid with and without agitation (solutions 2a, 2b, 4a, 4b, 7a, 7b, 9a, 9b, 11a and 11b).

Galvanically zinc-plated sheets were treated with the previously produced treatment solutions specified in Table 1 by dipping into the solutions for 60 seconds at 50° C. The sheets were then rinsed with water and subjected to a corrosion test in accordance with DIN 50021 SS (salt spray test) for drumware and the durations until the occurrence of i) first corrosion phenomena and ii) 5% white rust were compared. The results are set out in Table 2.

TABLE 2

| Treatment solution No | First corrosion phenomena | 5% white rust |
|---|---|---|
| 1a (invention) | 8 h | 24 h |
| 1b (Comp. Ex) | 3 h | 8 h |
| 2a (Comp. Ex) | 2 h | 7 h |
| 2b (Comp. Ex) | 2 h | 7 h |
| 3a (invention) | 24 h | 72 h |

TABLE 2-continued

| Treatment solution No | First corrosion phenomena | 5% white rust |
|---|---|---|
| 3b (Comp. Ex) | 4 h | 10 h |
| 4a (Comp. Ex) | 3 h | 10 h |
| 4b (Comp. Ex) | 8 h | 24 h |
| 5a (invention) | 12 h | 48 h |
| 5b (Comp. Ex) | 4 h | 12 h |
| 6a (invention) | 120 h | 168 h |
| 6b (Comp. Ex) | 5 h | 28 h |
| 7a (Comp. Ex) | 5 h | 20 h |
| 7b (Comp. Ex) | 8 h | 24 h |
| 8a (invention) | 48 h | 96 h |
| 8b (Comp. Ex) | 3 h | 16 h |

TABLE 2-continued

| Treatment solution No | First corrosion phenomena | 5% white rust |
|---|---|---|
| 9a (Comp. Ex) | 4 h | 12 h |
| 9b (Comp. Ex) | 8 h | 24 h |
| 10a (invention) | 72 h | 120 h |
| 10b (Comp. Ex) | 8 h | 28 h |
| 11a (Comp. Ex) | 5 h | 24 h |
| 11b (Comp. Ex) | 5 h | 24 h |

The invention claimed is:

1. An agent for the production of anti-corrosion layers on metal surfaces, produced by the following steps:

A) producing an aqueous solution which contains at least the following:

a) oxo-cations selected from $MnO_3^+$, $VO^{3+}$, $VO^{2+}$, $WO_2^{2+}$, $MoO_2^{2+}$, $TiO^{2+}$, $ZrO^{2+}$ and mixtures thereof, in a concentration of between 0.1 and 0.5% by weight, and b) halogen complex anions of the structure $MX_a^{b-}$, wherein M is selected from B, Ti, Zr, Si, Al, X is selected from F, Cl, Br, I, a is an integer of between 3 and 6 and b is an integer of between 1 and 4, in a concentration of between 0.1 and 3.0% by weight, and B) forming nanoparticles the formation of which results in a positive Tyndall effect and having a mean particle diameter of <500 nm in the solution in situ by physical and/or chemical treatment of the solution, wherein the physical and/or chemical treatment is selected from the group consisting of supersaturation of the solution with halogen complex anions, agitation of the solution, and a combination thereof.

2. An agent as set forth in claim 1 characterised by the further step C) in which there is added to the solution produced in accordance with step B) an oxidative substance selected from hydrogen peroxide, organic peroxides, alkali metal peroxides, persulfates, perborates, nitrates and mixtures thereof.

3. An agent as set forth in claim 2 characterised by the further step D) in which the pH-value of the solution produced in accordance with step C) is adjusted by means of an acid or base to a value in the range of between 0.5 and 5.0.

4. An agent as set forth in claim 2 characterised in that the solution obtained in step B) is diluted with water in a ratio of between 1:3 and 1:5 prior to the addition of an oxidative substance in step C).

5. An agent as set forth in claim 2 characterised by the further step D) in which the pH-value of the solution produced in accordance with step C) is adjusted by means of an acid or base to a value in the range of between 1.0 to 3.0.

6. An agent as set forth in claim 2 characterised by the further step D) in which the pH-value of the solution produced in accordance with step C) is adjusted by means of an acid or base to a value in the range of between 1.3 and 2.0.

7. An agent as set forth in claim 1 characterised in that the formation of nanoparticles in accordance with step B) is effected at a temperature in the range of between ambient temperature and 100° C.

8. An agent as set forth in claim 1 characterised in that the halogen complex anions b) of the aqueous solution in step A) are added in the form of their metal salts.

9. An agent as set forth in claim 1 characterised in that there are added to the aqueous solution in step A) further metal salts.

10. An agent as set forth in claim 1 characterised in that the halogen complex anions b) are selected from $BF_4^{1-}$, $TiF_6^{2-}$, $ZrF_6^{2-}$, $SiF_6^{2-}$, $AlF_6^{3-}$ and mixtures thereof.

11. An agent as set forth in claim 1 characterised in that the nanoparticles formed in step B) are of a mean particle diameter of <250 nm.

12. An agent as set forth in claim 1 characterised in that the formation of nanoparticles in accordance with step B) is effected at a temperature in the range of between 30° C. and 80° C.

13. An agent as set forth in claim 1 characterised in that the formation of nanoparticles in accordance with step B) is effected at a temperature in the range of between 35° C. and 50° C.

14. An agent as set forth in claim 1 characterised in that the halogen complex anions b) of the aqueous solution in step A) are added in the form of their alkali metal salts.

15. An agent as set forth in claim 1 characterised in that the halogen complex anions b) of the aqueous solution in step A) are added in the form of their sodium and potassium salts.

16. An agent as set forth in claim 1 characterised in that there are added to the aqueous solution in step A) further salts of the metals B, Ti, Zr, Si and/or Al.

17. An agent as set forth in claim 16, wherein said further salts of the metals B, Ti, Zr, Si and/or Al are in the form of the metal halides, metal nitrates and/or metal sulfates.

18. An agent as set forth in claim 1 characterised in that the aqueous solution produced in step A) contains the oxo-cations in a concentration of between 0.1 and 0.3% by weight.

19. An agent as set forth in claim 1 characterised in that the aqueous solution produced in step A) contains the halogen complex anions in a concentration of between 0.5 and 2.0% by weight.

20. An agent as set forth in claim 1 characterised in that the nanoparticles formed in step B) are of a mean particle diameter of <200 nm.

21. An agent as set forth in claim 1 characterised in that the nanoparticles formed in step B) are of a mean particle diameter of <150 nm.

* * * * *